US007973713B2

(12) United States Patent
Gallagher et al.

(10) Patent No.: US 7,973,713 B2
(45) Date of Patent: Jul. 5, 2011

(54) ELEMENT INDEPENDENT ROUTERLESS BEAMFORMING

(75) Inventors: Timothy C. Gallagher, Littleton, CO (US); William T. Horn, Centennial, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 379 days.

(21) Appl. No.: 12/252,305

(22) Filed: Oct. 15, 2008

(65) Prior Publication Data

US 2010/0090898 A1 Apr. 15, 2010

(51) Int. Cl.
*H01Q 3/00* (2006.01)

(52) U.S. Cl. ..... 342/373

(58) Field of Classification Search ..... 342/373
See application file for complete search history.

(56) References Cited

U.S. PATENT DOCUMENTS

| | | | | |
|---|---|---|---|---|
| 5,333,001 | A * | 7/1994 | Profera, Jr. | 342/373 |
| 5,734,345 | A * | 3/1998 | Chen et al. | 342/74 |
| 5,809,422 | A * | 9/1998 | Raleigh et al. | 455/449 |
| 6,052,085 | A * | 4/2000 | Hanson et al. | 342/373 |
| 6,101,399 | A * | 8/2000 | Raleigh et al. | 455/561 |
| 6,157,681 | A * | 12/2000 | Daniel et al. | 375/298 |
| 6,208,287 | B1 * | 3/2001 | Sikina et al. | 342/174 |
| 7,031,373 | B1 * | 4/2006 | Iyer | 375/148 |
| 7,260,141 | B2 * | 8/2007 | Bierly et al. | 375/222 |
| 2001/0020915 | A1 * | 9/2001 | Proctor, Jr. | 342/372 |
| 2005/0228841 | A1 * | 10/2005 | Grobert | 708/422 |
| 2006/0152403 | A1 * | 7/2006 | Wicks et al. | 342/25 R |
| 2006/0193373 | A1 | 8/2006 | Agee et al. | |

FOREIGN PATENT DOCUMENTS

EP 0 981 882 B1 11/2007

* cited by examiner

*Primary Examiner* — Thomas H Tarcza
*Assistant Examiner* — Frank McGue
(74) *Attorney, Agent, or Firm* — McDermott Will & Emery LLP

(57) ABSTRACT

Described herein are systems and methods that eliminate the need for costly and complex switching networks for routing channelized data between antenna elements and beamformers. In one aspect, a beamforming system comprises a beamformer for each antenna element of an antenna array, in which the beamformers for the different antenna elements are arranged in parallel. The beamforming system also comprises a combiner that combines the outputs of the beamformers into a single beam. In one aspect, the beamformers of antenna elements that do not contribute to a desired beam output zeros to the combiner, which when added to the subbeams of the other beamformers have no affect of the final beam. In another aspect, operations (e.g., multiplication, memory reads) of each beamformer that does not contribute to a desired beam may be turned off to conserve power.

30 Claims, 8 Drawing Sheets

ELEMENT INDEPENDENT ROUTERLESS BEAMFORMING

STATEMENT REGARDING FEDERALLY SPONSORED RESEARCH OR DEVELOPMENT

Not Applicable.

FIELD

The present invention relates generally to beamforming, and more particularly to beamforming using a plurality of beamformers.

BACKGROUND

Beamforming is a signal processing technique used in systems having an array of antenna elements to control the transmit and/or receive direction of the array. Systems that use beamforming may include radars (e.g., synthetic-aperture radars), satellite communication systems, phased-array antennas, wireless communications, radio astronomy, etc. For large antenna arrays, beamforming may require very significant and complex data movement and manipulation.

Before beamforming is applied, each antenna element's radio frequency (RF) input signal may be digitized by an analog-to-digital (A/D) converter and channelized by a channelizer. The channelizer breaks up the bandwidth of the respective digitized RF signal into narrow-band sections of the bandwidth, which may be referred to as "channels" or "subchannels." This signal processing substantially increases the data bandwidth in the system, especially as the number of antenna elements and/or "subchannels" grows. In conventional beamforming systems, a router comprising a large-complex network of switching elements is used to route only the data of interest to a set of beamformers to form a desired beam. The set of beamformers is less than the number of antenna elements since a typical beam only requires a subset of the antenna elements.

The router requires both complex routing control and data synchronization methods to ensure that, when a new beam is formed, the router simultaneously switches the desired channelized data from the desired antenna elements to the beamformers to form the new beam. In doing this, the router has to ensure that it does not drop or miss route data when changing to a different beam. The router becomes increasingly large, costly, complex, and power hungry as the system grows.

SUMMARY

Described herein are systems and methods that eliminate the need for costly and complex switching networks for routing channelized data between antenna elements and beamformers. In one aspect of the invention, each antenna element has a corresponding beamformer and the outputs of the beamformers are added together by a combiner to form the final beam. Since each antenna element has a corresponding beamformer, there is no need to route channelized data from selected antenna elements to a set of beamformers. In another aspect of the invention, beamformers that do not contribute to a particular beam output zeroes to the combiner, which when added together do not affect the final beam. This has the advantages of simplifying beam control.

In an aspect of the invention, a beamforming system comprises a beamformer for each antenna element of an antenna array, in which the beamformers for the different antenna elements are arranged in parallel. The beamforming system also comprises a combiner that combines the outputs of the beamformers into a single beam. Each beamformer may multiply channelized data from the respective antenna element with a weight to form a subbeam. The combiner may then combine the subbeams from the different beamformers to form the single beam. Since every antenna element has a corresponding beamformer, the beamforming system can process signals from any number of antenna elements in the array, providing a high degree of freedom in forming beams.

In one aspect of the invention, the beamformers of antenna elements that do not contribute to a desired beam output zeros to the combiner, which when added to the subbeams of the other beamformers have no affect of the final beam. This greatly simplifies beam control compared with signal routing using switching networks.

In another aspect of the invention, operations (e.g., multiplication, memory reads) of each beamformer that does not contribute to a desired beam may be turned off to conserve power.

Additional features and advantages of the invention will be set forth in the description below, and in part will be apparent from the description, or may be learned by practice of the invention. The advantages of the invention will be realized and attained by the structure particularly pointed out in the written description and claims hereof as well as the appended drawings.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate aspects of the invention and together with the description serve to explain the principles of the invention.

DETAILED DESCRIPTION

Described herein are systems and methods that eliminate the need for costly and complex switching networks for routing channelized data between antenna elements and beamformers. The systems and methods may be used in any application requiring beamforming. Applications include controlling the receive and/or transmit direction of phased-arrayed antennas, changing the direction of a synthetic-aperture radar to track a moving target, etc. Beamforming systems may be used in mobile wireless (cellular) and other wireless communication systems, reconnaissance receivers, etc.

Figure 1:
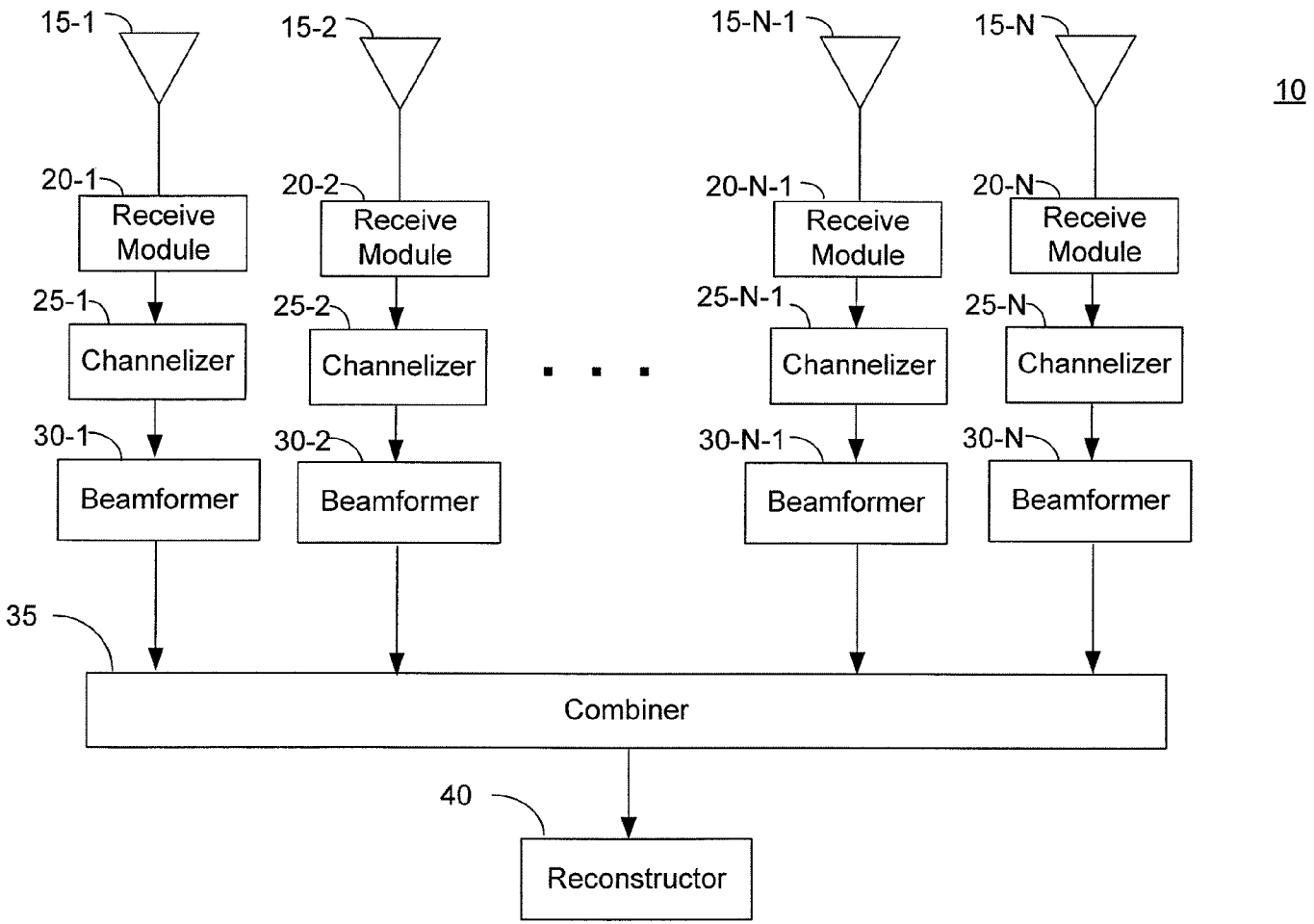
FIG. 1 is a block diagram of a system in accordance with one aspect of the invention.

FIG. 1 shows a block diagram of a receiving system 10 in accordance with one aspect of the invention. The system 10 comprises a plurality of spaced-apart antenna elements 15-1 to 15-N forming an antenna array, a plurality of receive modules 20-1 to 20-N, a plurality of channelizers 25-1 to 25-N, and a plurality of beamformers 30-1 to 30-N. Each of the antenna elements 15-1 to 15-N corresponds to one of the receive modules 20-1 to 20-N, one of the channelizers 25-1 to 25-N, and one of the beamformers 30-1 to 30-N. The system 10 further comprises a combiner 35 coupled to the outputs of the beamformers 30-1 to 30-N, and a reconstructor 40 coupled to the output of the combiner.

In operation, each antenna element 15-1 to 15-N may receive an RF signal. The signal from each antenna element 15-1 to 15-N may be processed by the respective receive module 20-1 to 20-N before being inputted to the respective channelizer 25-1 to 25-N. Each receive module 20-1 to 20-N may perform amplification, analog-to-digital conversion, and/or other processes on the received RF signal. Preferably, each receive module 20-1 to 20-N outputs a digital signal to the respective channelizer 25-1 to 25-N. Each channelizer 25-1 to 25-N breaks up the bandwidth of the respective digital signal into narrow-band sections of the bandwidth, which will be referred to as "subchannels" in the disclosure. Each channelizer 25-1 to 25-N may channelize the respective digital signal by using a series of filter banks that break up the bandwidth of the signal into smaller identical bandwidth, evenly spaced (in frequency) subchannels. The channelizers 25-1 to 25-N may be synchronized so that their digital signals correspond to the same sampling times.

After the digital signals have been channelized into subchannels, the beamformers 30-1 to 30-N may be used to form a beam, e.g., to achieve a desired receive direction for the array. For a particular beam, only the signals from a subset of the antenna elements 15-1 to 15-N may be required to form the beam, e.g., depending on a desired beam width and orientation. For example, for a system comprising 160 antenna elements, only a set of 10 to 19 antenna elements may contribute to a particular beam. Different beams may require different subsets of the antenna elements 15-1 to 15-N. For an example of a satellite, different antenna elements may be used to receive signals from different points on the ground relative to the satellite.

To form a desired beam at a particular subchannel, each beamformer 30-1 to 30-N of an antenna element 15-1 to 15-N contributing to the desired beam may scale the amplitude and/or shift the phase of the respective subchannel data according to the desired beam. The outputs of the beamformers 30-1 to 30-N may then be combined by the combiner 35 to form the final beam. The final beam is then inputted to the reconstructor 40. The reconstructor 40 may recombine beams for different subchannels into a composite bandwidth, which may be provided to a digital-to analog converter to convert band to the analog RF spectrum. To do this, the reconstructor 40 may use a transposed version of the filters used for channelization. The output of the reconstructor 40 may be sent, e.g., to a satellite transmitter or satellite communications receiver.

At a given time, only a subset of the beamformers 30-1 to 30-N may contribute to the final beam since only a subset of the antenna elements 15-1 to 15-N may be required for a particular beam. In one aspect of the invention, the beamformers 30-1 to 30-N that do not contribute to the final beam at a given time output zeroes to the combiner 35, which when added to the outputs of the contributing beamformers 30-1 to 30-N do not affect the final beam output.

The system 10 is element independent in the sense that any number of the antenna elements 15-1 to 15-N in the array may be used to form a beam. Since each antenna element 15-1 to 15-N has a corresponding beamformer 30-1 to 30-N, the system 10 can handle the maximum number N of antenna elements 15-1 to 15-N in the array. Thus, anywhere from one to the maximum number N of antenna elements 15-1 to 15-N in the array may be used to form a desired beam. This element independence provides a high degree of flexibility in beam forming since any number and arrangement of antenna elements 15-1 to 15-N may be used to form a beam.

In the system 10, each antenna element 15-1 to 15-N has a corresponding beamformer 30-1 to 30-N. This eliminates the need for complex routing and real-time routing control between the antenna elements 15-1 to 15-N and the beamformers 30-1 to 30-N. In one aspect of the invention, the beamformers 30-1 to 30-N that do not contribute to a particular beam may simply output zeros to the combiner 35, which do not affect the final beam outputted by the combiner 35, and/or be turned off. This greatly simplifies beamforming control compared with routing signals from selected antenna elements to a set of beamformers. Further, each antenna 15-1 to 15-N has a dedicated data path to the corresponding beamformer 30-1 to 30-N. This allows better synchronization and timing among the beamformers 30-1 to 30-N compared with a router comprising a complex switching network. This is because, unlike a router, the system 10 does not have to switch many different switching elements on the fly to form different data paths between the antenna elements of interest and the beamformers for each beam, which may result in mis-routed data. Also, the data paths in a router may be unpredictable and have different delays for different beams, which make synchronization more difficult and may result in dropped data. In contrast, the data paths in the system 10 are predictable and may be configured to have similar delays to provide better synchronization. Further, the system 10 is easily scalable to any number of antenna elements and beamformers by simply adding more antenna elements and beamformers in parallel to the system 10.

Figure 2:
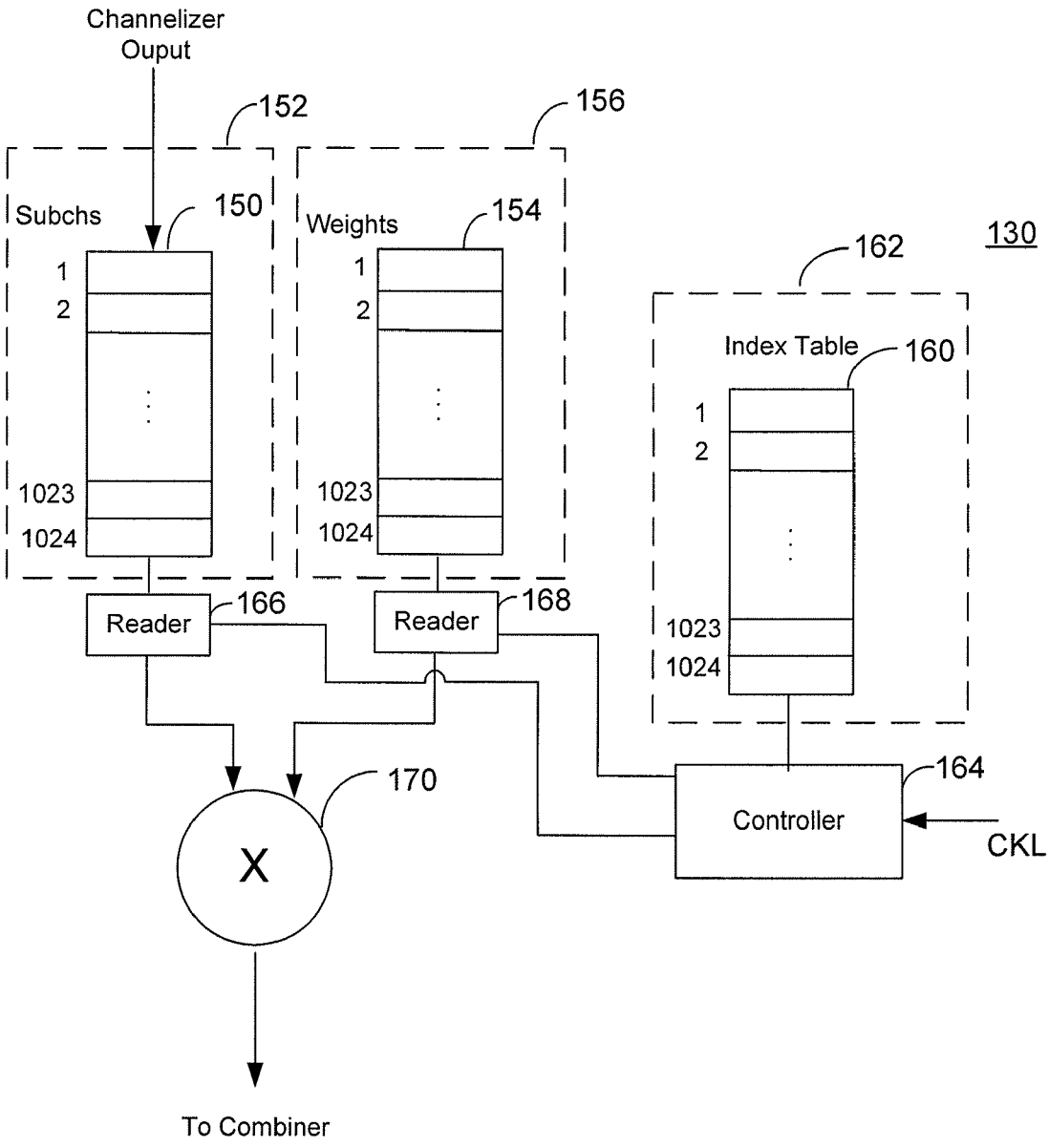
FIG. 2 is a block diagram of a beamformer in accordance with one aspect of the present invention.

FIG. 2 shows a block diagram of a beamformer 130 in accordance with one aspect of the invention. Each of the beamformers 30-1 to 30-N in FIG. 1 may be implemented using the beamformer in FIG. 2. The beamformer 130 comprises an input memory 152, a weight table memory 156, an index table memory 162, a reader 166 coupled to the input memory 152, and a reader 168 coupled to the weight table memory 156. The beamformer 130 further comprises a controller 164 and a multiplier 170.

In operation, the channelized data received by the beamformer 130 are stored in the input memory 152. In one aspect, the input memory 152 stores the subchannel data in a subchannel table 150 comprising a plurality of subchannel bins corresponding to the different subchannels of the channelized data. In the example shown in FIG. 2, the subchannel table 150 comprises 1024 subchannel bins, although any number of subchannels may be used. The subchannel data received by the beamformer 130 may be sequentially written into the corresponding subchannel bins of the subchannel table 150. In one aspect of the invention, the subchannel data stored in the input memory 152 may be complex subchannel data having both in-phase (I) and quadrature (Q) components that provide amplitude and phase information.

The reader 166 coupled to the input memory 152 may be configured to read out data for a desired subchannel according to a subchannel bin number. The reader 166 may randomly read out data from the input memory 152 for random access to the stored subchannel data. In one aspect, the input memory 152 may comprise two subchannel tables, in which the two subchannel tables alternate between storing incoming subchannel data and reading out stored subchannel data. In this aspect, the input memory 152 may be implemented using dual (ping-pong) memory buffers, with each buffer storing one of the tables, and the buffers alternating between storing incoming data and reading out data.

The weight table memory 156 stores a weight table 154 comprising a plurality of beam weights corresponding to different beams. The beam weight for a particular beam may be indexed by a beam index number, and stored in a corresponding beam index position in the weight table 154. In the example shown in FIG. 2, the weight table 154 comprises 1024 beam index positions for storing up to 1024 weights corresponding to 1024 different beams, although other numbers of bin index positions may be used. For beams in which the beamformer 130 does not contribute, the weight table 154 may store zeros in the corresponding beam index positions.

The reader 168 coupled to the weight table memory 152 may be configured to read out a beam weight from the weight table 154 according to a beam index number corresponding to a desired beam. In one aspect of the invention, the weights stored in the weight table 154 are complex weights having both in-phase (I) and quadrature (Q) components. This allows a weight to both scale the amplitude and/or shift the phase of subchannel data according to a desired beam.

The index table memory 162 stores an index table 160 comprising a plurality of index positions. In each index position, the index table 160 may store a subchannel bin number and a beam index number. In the example shown in FIG. 2, the index table 160 has 1024 index positions, although other numbers of index positions may be used. As explained further below, the index table 160 may be used to form a sequence of beams. The controller 164 may include a reader (not shown) for reading the subchannel bin numbers and beam index numbers from the index table 160.

The multiplier 170 is configured to multiply subchannel data from reader 166 with a beam weight from reader 168 to form a subbeam, which is outputted to the combiner 35. The combiner 35 may combine the subbeam with subbeams from other beamformers to form the final beam. In one aspect of the invention, the multiplier 170 comprises a complex multiplier configured to multiply complex subchannel data with a complex beam weight to form the subbeam. The complex beam weight can scale the amplitude and/or shift the phase of the subchannel data when the two are multiplied together by the complex multiplier 170.

The controller 164 is configured to control the beamformer 130 based on the index table 160. The controller 164 may receive a clock signal CKL to synchronize the beamformer 130 with the other beamformers in the system. In one aspect of the invention, the controller 164 controls the beamformer 130 so that the beamformer 130 forms and outputs a subbeam corresponding to a desired beam on each clock cycle.

During a clock cycle, the controller 164 may read a subchannel bin number and a beam index number from the index table 160. The controller 164 may then send the subchannel bin number to reader 166 to read out the corresponding subchannel data from the input memory 152, and send the beam index number to reader 168 to read out the corresponding beam weight from the weight table memory 156. The multiplier 170 may then multiply the read out subchannel data and beam weight to form the subbeam.

In one aspect of the invention, the controller 164 may sequence through the index table 160 to form a sequence of beams. For example, the controller 164 may increment the index position by one for each clock cycle. In each clock, the controller 164 may read the subchannel bin number and beam weight from the index position for that clock cycle to control which subchannel and beam weight are used for that clock cycle. The controller 164 may continuously cycle through the index table 162 in a loop to form a repeating sequence of beams.

Figure 3:
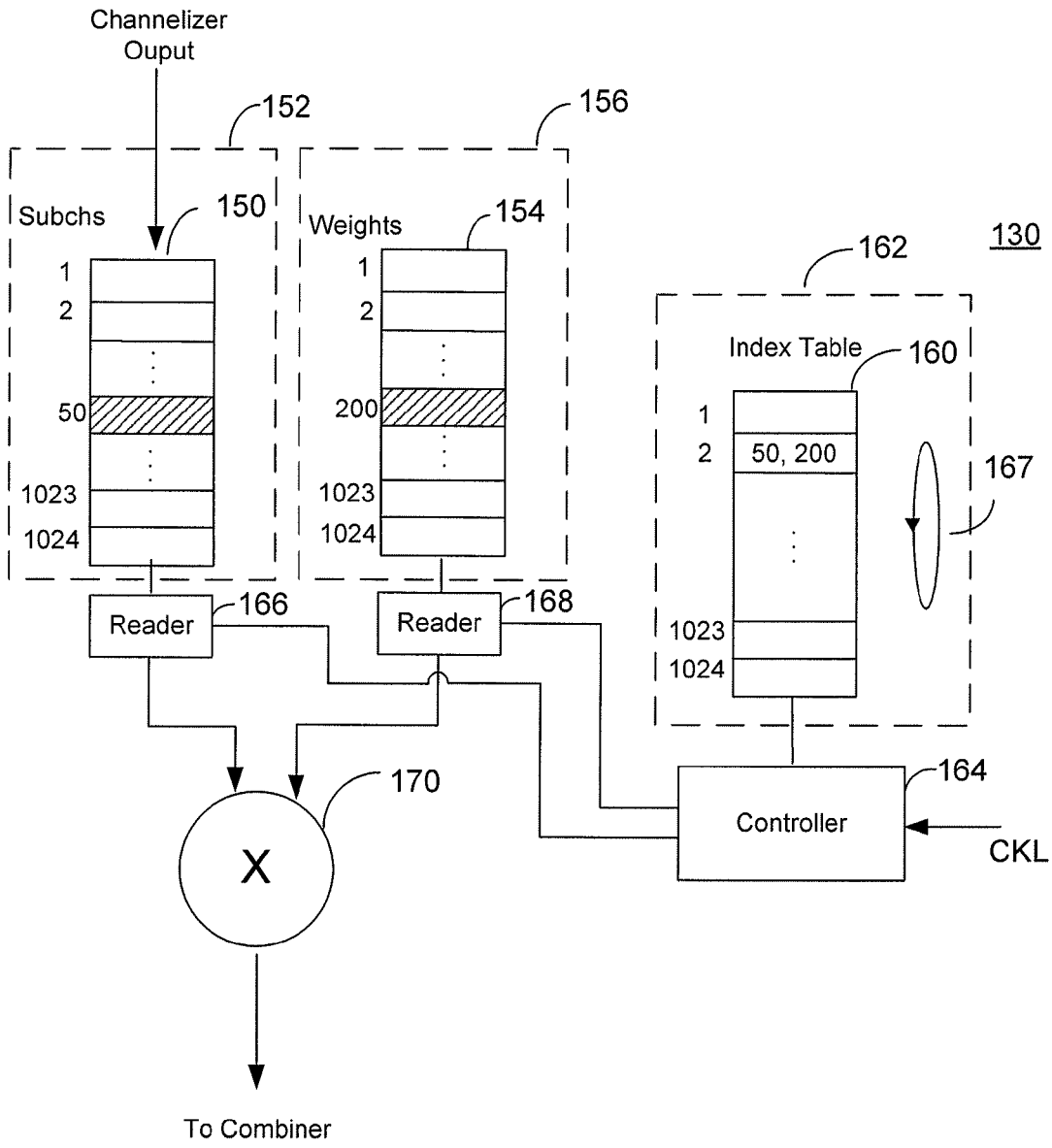
FIG. 3 shows an example of a beamformer using an index table to determine which subchannel and beam weight to use.

FIG. 3 shows an example in which the subchannel bin number and beam index number stored in the index table 162 point to the subchannel and beam weight to be used in a particular clock cycle. In this example, the controller 162 reads a subchannel bin index of 50 and beam index number of 200 from index position 2 in the index table 160. As a result, the subchannel data stored in subchannel bin 50 and the beam weight stored in beam index position 200 are used to form the subbeam of the beamformer 130 during the clock cycle. The loop 167 in FIG. 3 indicates that the controller 164 may continuously cycle through the index table 160 to form a repeating sequence of beams.

As discussed above, the beamformer 130 may output a zero to the combiner 35 for beams in which the beamformer 130 does not contribute. In one aspect, the weight table 154 stores zeroes in the beam index positions corresponding to beams in which the beamformer 130 does not contribute. As a result, a zero weight is read out of the weight table 154 when the beamformer 130 does not contribute to a beam. The zero weight causes the multiplier 170 to output a zero to the combiner 35, which does not affect the final beam outputted by the combiner 35. This aspect has the advantage of simplifying the control of data flow.

Figure 4:
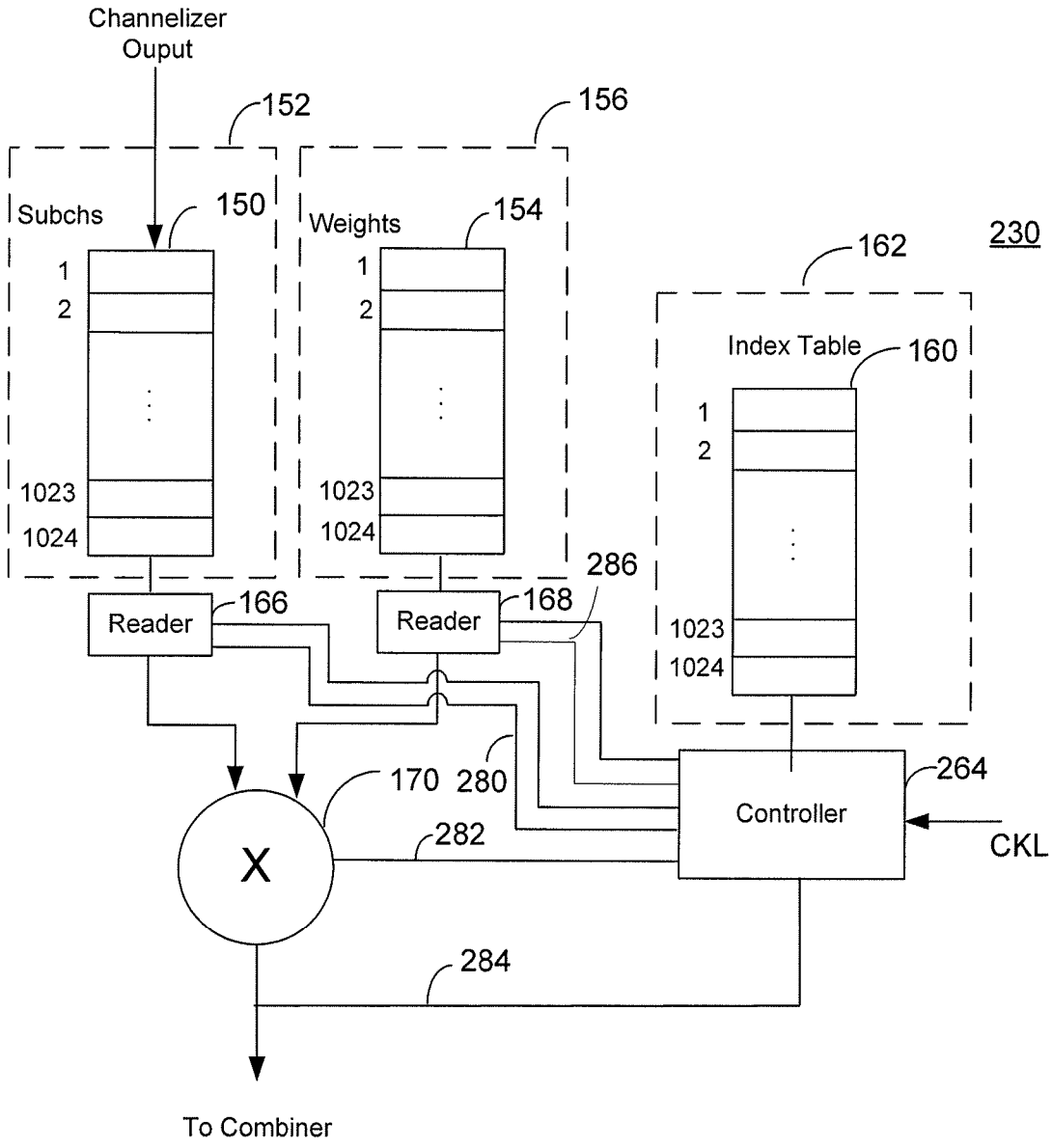
FIG. 4 is a block diagram of a beamformer in accordance with another aspect of the invention.

FIG. 4 shows a beamformer 230 in accordance with another aspect of the invention. In this aspect, the controller 264 has a power control line 280 coupled to the reader 166 and a power control line 282 coupled to the multiplier 170. This allows the controller 264 to control whether the reader 166 and the multiplier 170 are turned on or off. In this aspect, the controller 264 may turn off the reader 166 and the multiplier 170 when the beamformer does not contribute to a beam to conserve power. To do this, the controller 170 may read the beam weight for the next clock cycle by looking ahead in the index table 162 for the beam index number in the next clock cycle and reading the beam weight for the next clock cycle. If the beam weight is zero, then the controller 264 may turn off the reader 166 and the multiplier 170 during the next clock cycle. Thus, the reader 166 and the multiplier 170 may be turned off to converse power on a cycle-by-cycle basis when the beamformer is not used. In this aspect, the combiner 35 may be configured to ignore the beamformer 130 when it does not receive an output from the multiplier 170.

The controller 264 may also be coupled to the output of the beamformer 130, as shown in FIG. 4. In this aspect, the controller 264 turns off the reader 166 and the multiplier 170 when it reads a zero weight for the next clock cycle. In addition, the controller 264 outputs a zero to the combiner 35 on output 284 during the next clock cycle. Thus, the controller 264 bypasses the reader 166 and the multiplier 170 and outputs a zero to the combiner 35 when the beamformer 130 does not contribute to the beam. The zero outputted to the combiner 35 does not affect the final beam.

Each of the beamformers 30-1 to 30-N of the system 10 may be implemented using the beamformers 130 and 230 shown in FIGS. 3 and 4.

Figure 5:
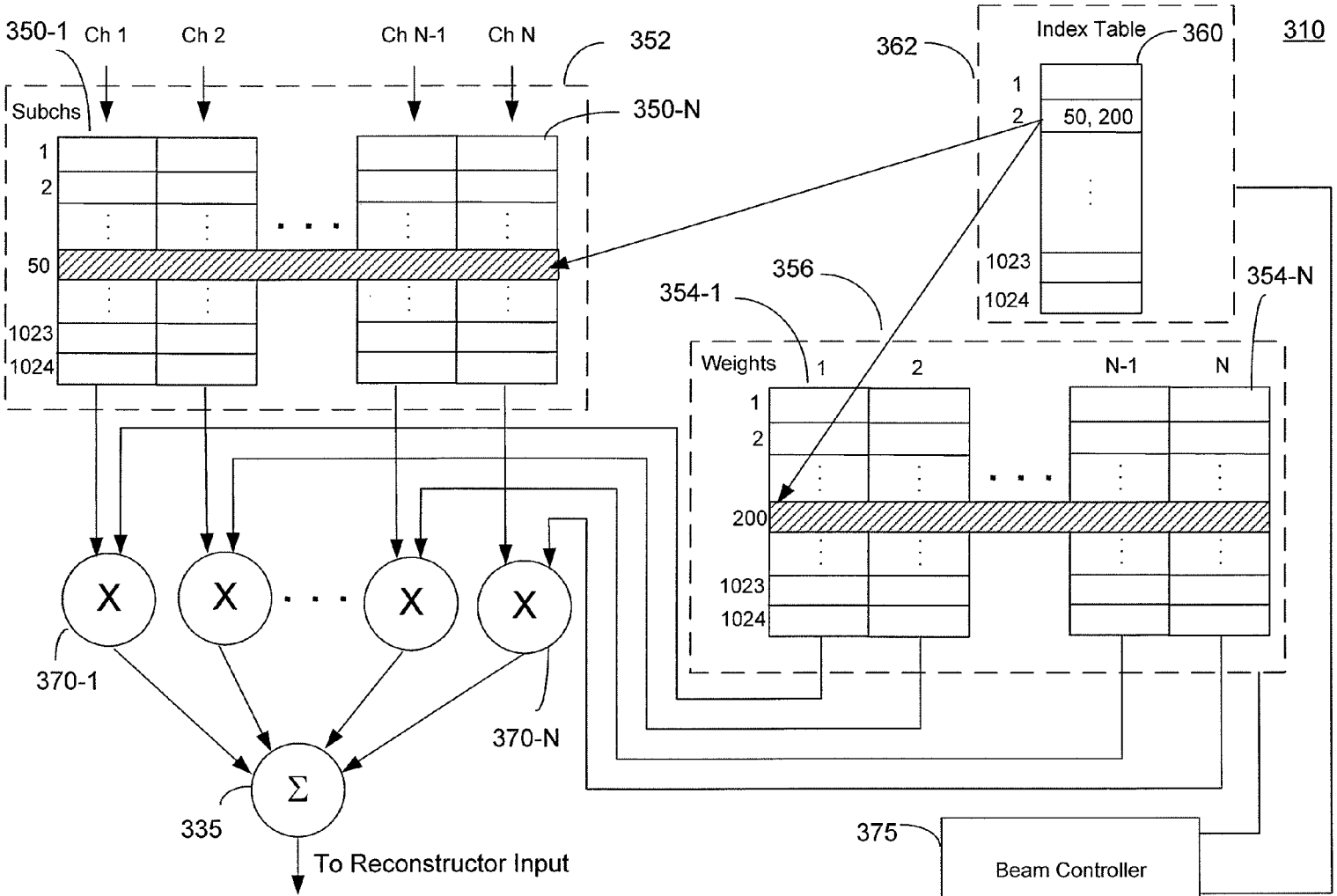
FIG. 5 is a block diagram of a system in accordance with another aspect of the invention.

FIG. 5 shows an example of a system 310 comprising a plurality of subchannel tables 350-1 to 350-N, weight tables 354-1 to 354-N, and multipliers 370-1 to 370-N. In this example each of the beamformers comprises one of the subchannel tables 350-1 to 350-N, one of the weight tables 354-1 to 354-N, and one of the multipliers 370-1 to 370-N. Each subchannel table 350-1 to 350-N stores subchannel data from the channelizer for the respective beamformer, and each weight table 354-1 to 354-N stores the beam weights for the respective beamformer. The subchannel tables 350-1 to 350-N are shown side-by-side in FIG. 5 for ease of illustration, although it is to be understood that the subchannel tables 350-1 to 350-N may be stored in the same memory 352 or different memories 352. Similarly, the weight tables 354-1 to 354-N may be stored in the same memory 356 or different memories 356. Also, the readers and controller of each beamformer have been omitted from FIG. 5 for ease of illustration and to avoid cluttering FIG. 5, although it is to be understood that the read and control functions of each beamformer described below may be implemented using the readers and controller shown in FIGS. 2-4.

An index table 360 is used to control which subchannel and beam weights are used to form each beam. The index table 360 comprises a plurality of index positions where each index position stores a subchannel bin number and a beam index number. In the example shown in FIG. 5, the index table 360 comprises 1024 index positions, although any number of index positions (e.g., 512) may be used. Each beamformer may have its own copy of the index table 360 and/or multiple beamformers may share a copy of the index table 360. The index table 360 may be stored in one memory 362 or a copy of the index table 360 may be stored in each of a plurality of memories 362.

In operation, each beamformer may sequence through the index table 360 to determine which subchannel and beam weight to use to form each beam. Each beamformer may sequence through its own copy of the index table 360 stored in local memory 360. In one aspect, the beamformers start at the same index position in the index table 360 and sequence through the index table 360 based on the same clock to keep the beamformers synchronized. In each clock cycle, each beamformer reads out the subchannel data from its subchannel table 350-1 to 350-N and reads out the beam weight from its weight table 354-1 to 354-1 based on the subchannel bin number and beam index number, respectively, indicated by the index table 360 for the clock cycle. FIG. 5 shows an example in which the index table 360 specifies subchannel bin 50 and beam index number 200 in one clock cycle. In this example, each beamformer reads out the subchannel data in subchannel bin 50 of its subchannel table 3501-350-N and read outs the beam weight in beam index position 200 of its weight table 354-1 to 354-N.

Each beamformer then multiplies its subchannel data and beam weight using its multiplier 370-1 to 370-N to form a subbeam. The subbeams of the beamformers may then be added together by the combiner 335 to form the final beam, which is outputted to the reconstructor. In one aspect, the beamformers that do not contribute to a beam at a given time may output zeroes to the combiner 335, which when added to the subbeams of the other beamformers has no affect the final beam. The combiner 335 may add the subbeams together in a "tree" fashion, in which the subbeams from the beamformers are added together in groups and the results of the group additions are added together to form the final beam.

By sequencing through the index table 360, the beamformers are able to form a sequence of beams. The index table 360 and weight tables 354-1 to 354-N may be programmed to achieve a desired sequence of beams. In one aspect, different types of beams may be programmed into the weight tables 354-1 to 354-N where each type of beam corresponds to a beam index number, and may called by the index table 360 using the corresponding beam index number. For each beam, the beam weights for the beamformers needed to achieve the beam may be programmed into the weight tables 354-1 to 354-N for the corresponding index beam number. After the beams are programmed into the weight tables 354-1 to 354-N, a sequence of beams may be programmed into the index table 360 by programming a sequence of beam index numbers into the index table 360 corresponding to the desired sequence of beams. FIG. 5 shows an example of a beam controller 375 coupled to the weight tables 354-1 and 354-N and index table 360 for programming a desired beam sequence. In this aspect, the controller 375 may write beam weights into the weight tables 354-1 to 354-N corresponding to different beams and may write index beam numbers into the index table 360 in a sequence corresponding to the desired sequence.

In one aspect of the invention, the system 310 may comprise two index tables, in which one index table is active at a time, and the other index table is offline. In this aspect, the controller 375 may program the offline index table while the other index table is used for beamforming. After the offline index table is programmed, it may be brought online and used for a beamforming while the other index table goes offline. This allows the system to be updated with a new sequence of beams during operation. For an example of a satellite, the new sequence can be uploaded to the satellite from a ground station.

In another aspect, the index table 360 may include an additional entry at each index position specifying a range of beamformers that contribute to a beam. In each clock cycle, each beamformer may look at the range of contributing beamformers in the index table 360 to determine whether it contributes to the beam in the clock cycle. If a beamformer does not contribute to the beam, then the beamformer may output a zero to the combiner 335, which does not affect the final beam. In another aspect, each beamformer may have its own index table, in which the index table includes an indicator at each index position indicating whether the beamformer contributes to the corresponding beam. In this example, each beamformer may be implemented as shown in FIG. 4 and the controller 264 of each beamformer 230 that does not contribute to the beam may turn off both readers 166 and 168 and the multiplier 170 to conserve power. The beamformer 230 in FIG. 4 may include a power control line 286 between reader 168 and the controller 264 to turn off reader 168.

Figure 6:
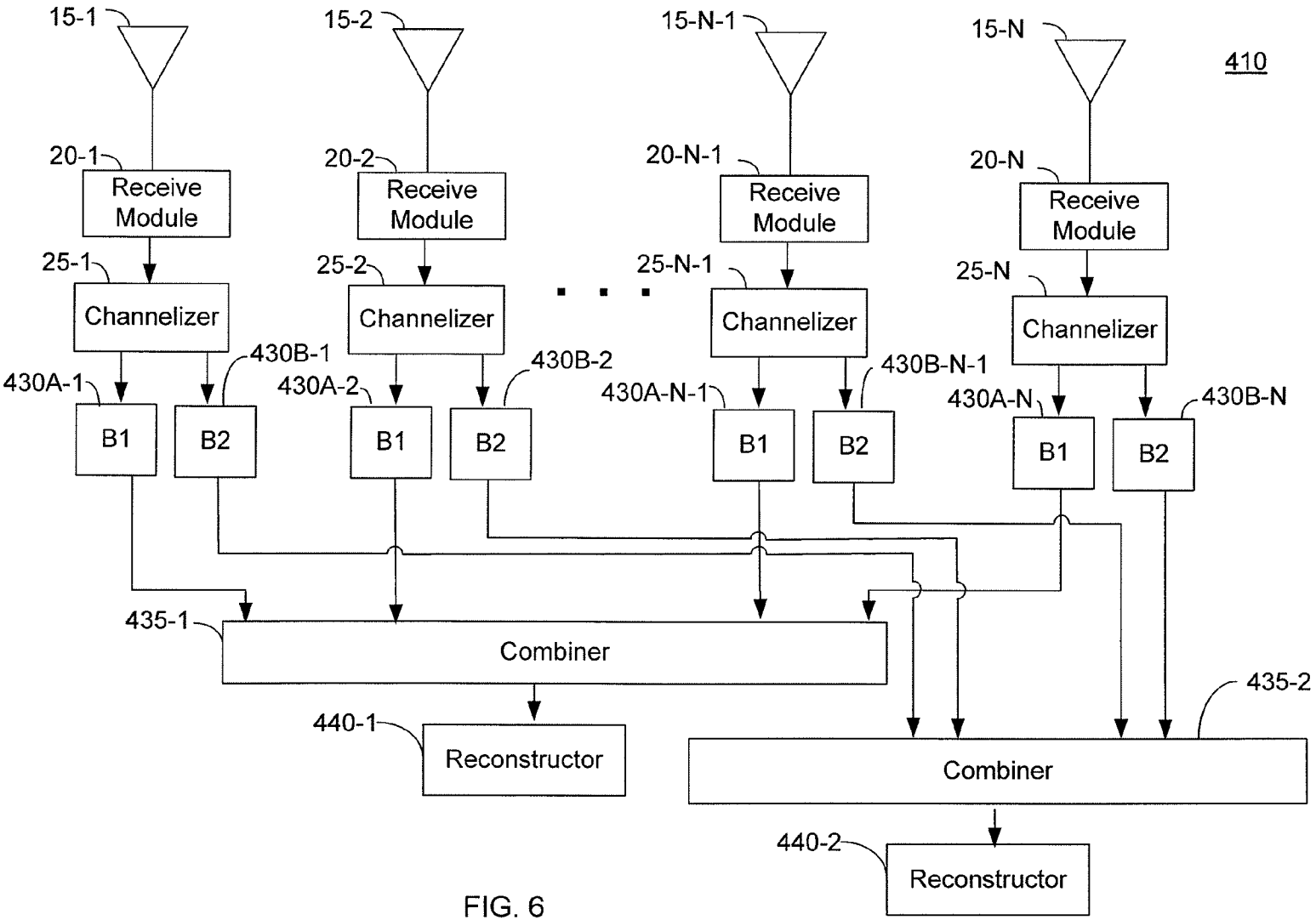
FIG. 6 is a block diagram of a system capable of forming two beams at a time in accordance with an aspect of the invention.

FIG. 6 shows a system 410 for outputting multiple beams at a time in accordance with one aspect of the invention. The system 410 is similar to the system shown in FIG. 1 with two groups of beamformers 430A-1 to 430A-N and 430B-1 to 430B-N for forming two beams at a time. Each of the channelizers 25-1 to 25-N is coupled to two beamformers (one from each group of beamformers 430A-1 to 430A-N and 430B-1 to 430B-N). The system 410 also comprises two combiners 435-1 and 435-2 and two reconstructors 440-1 and 440-2. Combiner 435-1 is coupled to the outputs of beamformers 430A-1 to 430A-N while combiner 435-2 is coupled to the outputs of beamformers 430B-1 to 430B-N. Reconstructor 440-A is coupled to the output of combiner 435-A while reconstructor 440-B is coupled to the output of combiner 435-B. Each group of beamformers 430A-1 to 430A-N and 430B-1 to 430B-N may be implemented using the breamfomers shown in FIG. 5, and each group of beamformers may have its own index table for forming a sequence of beams. Although two groups of beamformers are shown in FIG. 6, the system may include more than two groups of beamformers depending on the desired number of beams. For example, the system may include four groups of beamformers, in which each channelizer 25-1 to 25-N is coupled to four beamformers (one from each group) and each group of beamformers is coupled to a separate combiner and reconstructor to form one of the four beams. Thus, the system may be configured to output any number of beams at a time.

Figure 7:
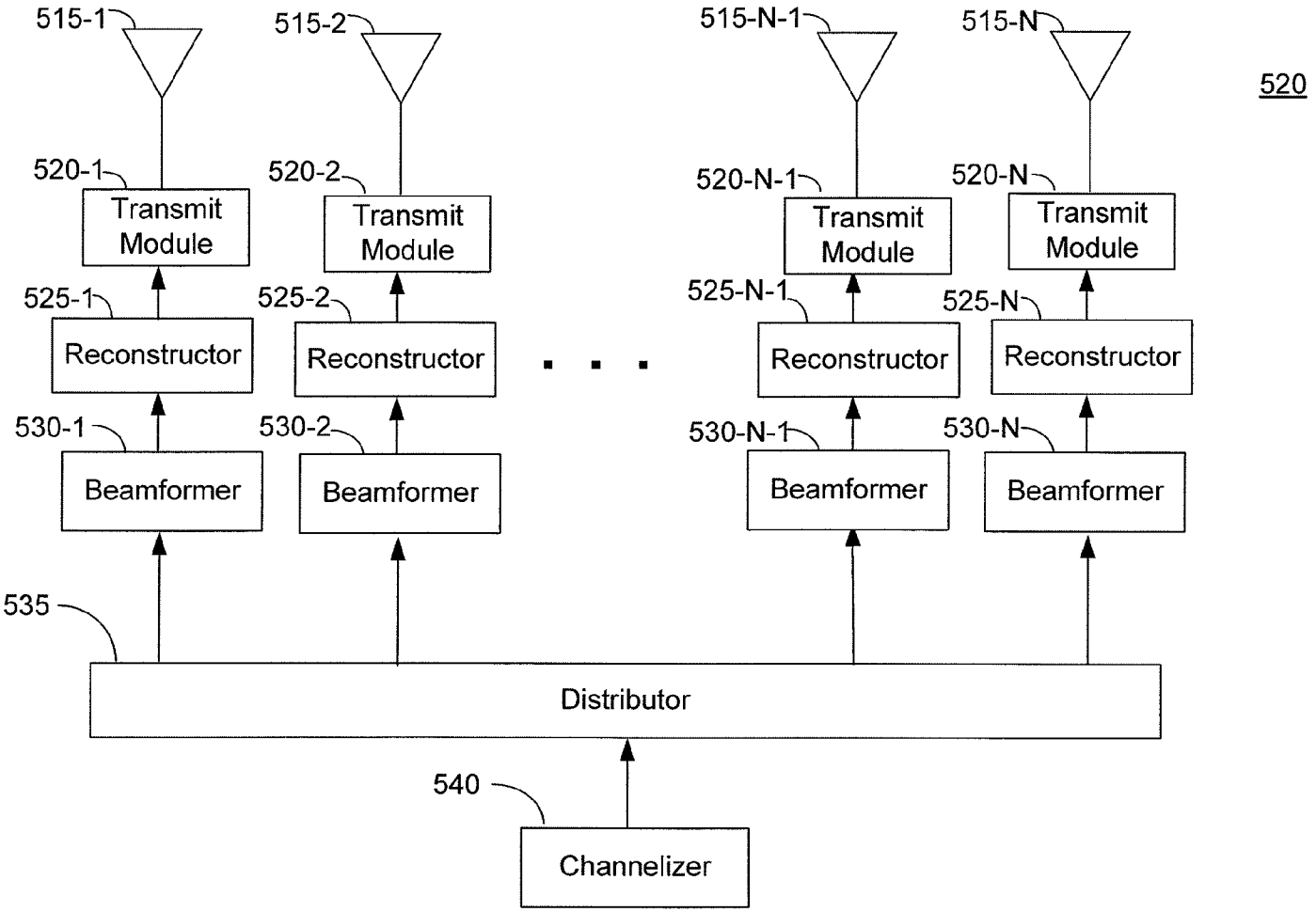
FIG. 7 is a block diagram of a system in accordance with another aspect of the invention.

FIG. 7 shows a block diagram of a transmitting system 510 in accordance with an aspect of the invention. The system comprises a plurality of spaced-apart antenna elements 515-1 to 515-N forming an antenna array. For each antenna element 515-1 to 515-N, the system 510 comprises a beamformer 530-1 to 530-N, a reconstructor 525-1 to 525-N, and a transmit module 520-1 to 520-N. The system 510 also comprises a channelizer 540 and a distributor 535.

In operation, the channelizer channelizes an input signal, and the distributor 535 distributes the channelized data to the beamformers 530-1 to 530-N to form a beam, e.g., to achieve a desired transmit direction. The same channelized data may be outputted to all of the beamformers 630-1 to 630-N. To form a desired beam at a particular subchannel, each beamformer 530-1 to 530-N contributing to the beam may scale the amplitude and/or shift the phase of the respective subchannel data according to the desired beam. The outputs of the beamformers 530-1 to 530-N are inputted to the respective reconstructors 525-1 to 525-N to reconstruct signals spanning a desired bandwidth. The outputs of the reconstructors 525-1 to 525-N are then inputted to the respective transmit modules 520-1 to 520-N. Each transmit module 520-1 to 520-N may perform amplification, digital-to-analog conversion and/or other processes on the output signal of the respective reconstructor 525-1 to 525-N before feeding the signal to the respective antenna element 515-1 to 515-N for transmission.

The transmitting system 510 in FIG. 7 is element independent in the sense that any number of antenna elements 515-1 to 515-N in the array may be used to form a beam for transmission. Since each antenna element 515-1 to 515-N has a corresponding beamformer 530-1 to 530-N, the system 150 can handle the maximum number of antenna elements 515-1 to 515-N in the array. This element independence provides a high degree of freedom in forming beams for transmission. Further, the system eliminates the need for complex routing and real-time routing controls between the beamformers 530-1 to 530-N and the antenna elements 515-1 to 515-N because each beamformer 530-1 to 530-*n* has a dedicated data path to the respective antenna element 515-1 to 515-N. This simplifies beamforming control compared to routing signals from a set of beamformers to selected antenna elements in an array.

Figure 8:
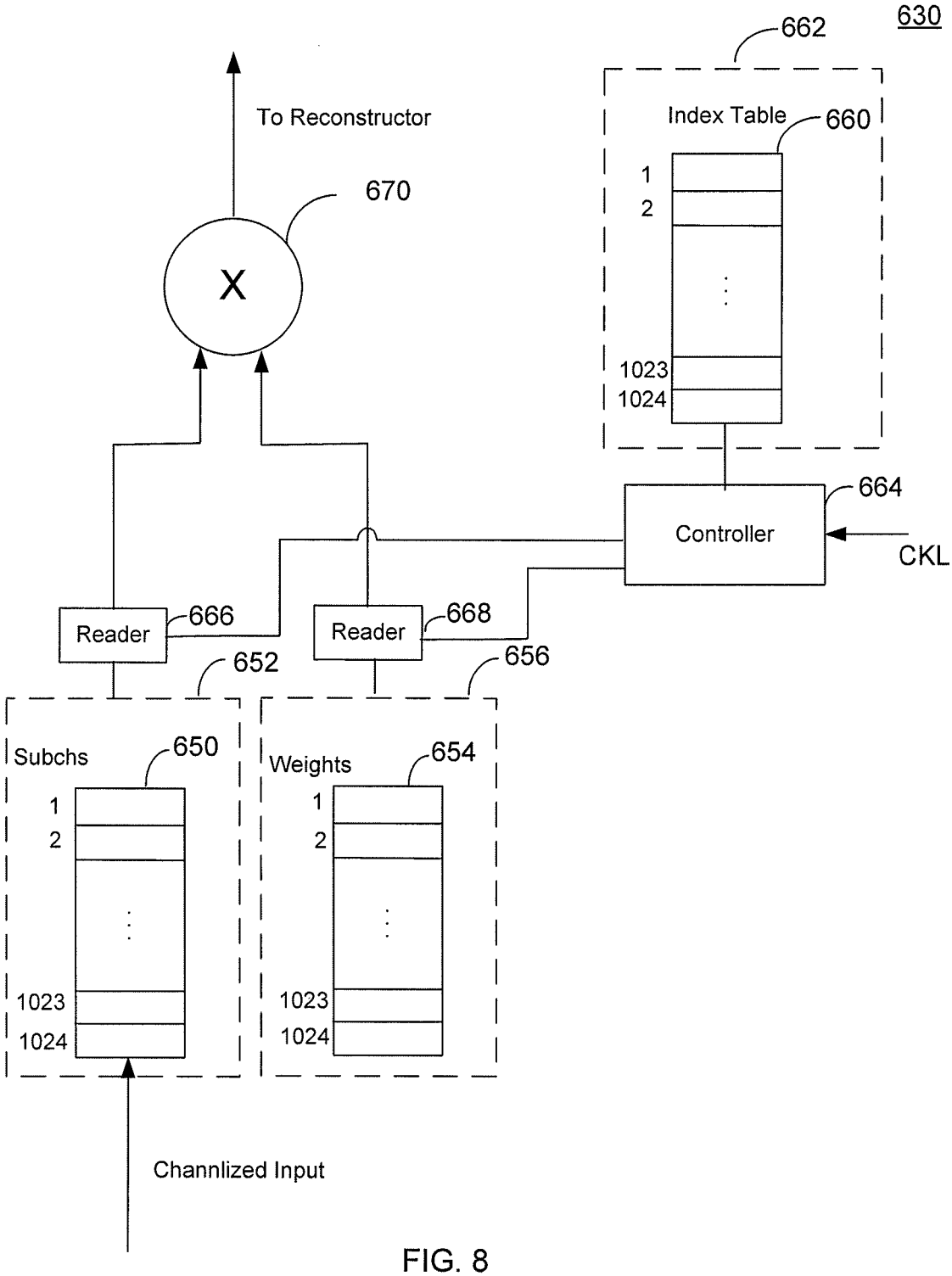
FIG. 8 is a block diagram of a beamformer in accordance with another aspect of the invention.

FIG. 8 shows a block diagram of one of the beamformers 630 in a transmitting system in accordance with one aspect of the invention. The beamformer 630 operates on a similar principle as the beamformer 130 in FIG. 2 with the channelized data flowing in a reverse direction from FIG. 2. The beamformer 630 comprises an input memory 652, a weight table memory 656, an index table memory 662, a reader 666 coupled to the input memory 652, and a reader 668 coupled to the weight table memory 656. The beamformer 630 further comprises a controller 664 and a multipler 670.

In operation, the beamformer 630 receives channelized data from the distributor 635. The channelized data received by the beamformer 630 are stored in the input memory 652. In one aspect, the input memory 652 stores the subchannel data in a subchannel table 650 comprising a plurality of subchannel bins corresponding to the different subchannels of the channelized data in a manner similar to the beamformer in FIG. 2. The reader 666 coupled to the input memory 652 may be configured to read out data for a desired subchannel according to a subchannel bin number. The reader 666 may randomly read out data from the input memory 652 for random access to the stored subchannel data.

The weight table memory 656 stores a weight table 654 comprising a plurality of beam weights corresponding to different beams. The beam weight for a particular beam may be indexed by a beam index number, and stored in a corresponding beam index position in the weight table 654. The reader 668 coupled to the weight table memory 652 may be configured to read out a beam weight from the weight table 654 according to a beam index number corresponding to a desired beam.

The index table memory 662 stores an index table 660 comprising a plurality of index positions. In each index position, the index table 660 may store a subchannel bin number and a beam index number. As explained further below, the index table 660 may be used to sequence through beams in a manner similar to the receiving system 510 in FIG. 5.

The multiplier 670 is configured to multiply subchannel data from reader 666 with a beam weight from reader 668 to form an output signal, which is outputted to the respective reconstructor 525-1 to 525-N. The controller 664 is configured to control the beamformer 630 based on the index table 660. The controller 664 may receive a clock signal CKL to synchronize the beamformer 630 with the other beamformers in the system.

During a clock cycle, the controller 664 may read a subchannel bin number and a beam index number from the index table 660. The controller 664 may then send the subchannel bin number to reader 666 to read out the corresponding subchannel data from the input memory 652, and send the beam index number to reader 668 to read out the corresponding beam weight from the weight table memory 656. The multiplier 670 may then multiply the read out subchannel data and beam weight to form an output signal for transmission.

In one aspect of the invention, the controller 664 may sequence through the index table 660 to form a sequence of beams (one beam for each clock cycle). When the beamformer 630 does not contribute to a beam, the beamformer 630 may output a zero to the respective reconstructor 620-1 to 620-N. The controller 664 may also turn off the reader 666 and the multiplier 670 for beams in which the beamformer 630 does not contribute in a manner similar to the beamformer 230 in FIG. 4.

Those skilled in the art will appreciate that the beamformers and controllers described in connection with the embodiments disclosed herein may be implemented or performed with general purpose processors, a digital signal processors (DSPs), application specific integrated circuit (ASICs), field programmable gate array (FPGAs), logic programmable devices, discrete hardware components, or any combination thereof. Further, the algorithms performed by the beamformers and controllers may be embodied in software executed by a processor, directly in hardware, or a combination thereof. The software may be stored in memory or any computer-readable storage medium known in the art.

The memories described in the disclosure may comprise machine readable media. Readable media may include storage integrated into a processor, such as might be the case with an ASIC, and/or storage external to a processor. By way of illustration, and not limitation, readable media may include one or more of volatile memory, nonvolatile memory, a Random Access Memory (RAM), a flash memory, a Read Only Memory (ROM), a Programmable Read-Only Memory (PROM), an Erasable PROM (EPROM), a register, a hard disk, a removable disk, a CD-ROM, a DVD, or any other suitable storage device. In addition, readable media may include a transmission line or a carrier wave that encodes a data signal. A readable medium may be a computer-readable medium encoded or stored with a computer program or instructions. The computer program or instructions may be executable by a transmitter or receiver device or by a processing system of a transmitter or receiver device.

Those of skill in the art would appreciate that the various illustrative blocks, modules, elements, components, methods, and algorithms described herein may be implemented as electronic hardware, computer software, or combinations of both. Furthermore, these may be partitioned differently than what is described. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application.

It is understood that the specific order or hierarchy of steps or blocks in the processes disclosed is an illustration of exemplary approaches. Based upon design preferences, it is understood that the specific order or hierarchy of steps or blocks in the processes may be rearranged. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." All structural and functional equivalents to the elements of the various aspects described throughout this invention that are known or later come to be known to those of ordinary skill in the art are expressly incorporated herein by reference and are intended to be encompassed by the claims. Moreover, nothing disclosed herein is intended to be dedicated to the public regardless of whether such invention is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A system for beamforming signals from a plurality of antenna elements, comprising:

for each antenna element:

a channelizer coupled to the respective antenna element, the channelizer configured to channelize a signal received by the respective antenna element into a plurality of subchannels and output subchannel data for each of the plurality of subchannels; and a beamformer coupled to the respective channelizer, the beamformer configured to receive the subchannel data for each of the plurality of subchannels from the respective channelizer and to multiply the received subchannel data for each of at least one of the plurality of subchannels with a beam weight corresponding to the subchannel and the respective antenna element to form a subbeam; and a combiner configured to combine a plurality of the subbeams from the beamformers into a beam.

2. The system of claim 1, wherein each beamformer comprises:

an input memory configured to store the subchannel data for each of the plurality of subchannels from the respective channelizer into a subchannel table, the subchannel table comprising a plurality of subchannel bins, each subchannel bin corresponding to one of the plurality of subchannels;

a reader configured to read out subchannel data from the subchannel table based on a subchannel bin number; and a multiplier configured to multiply the read subchannel data with the respective beam weight to form the respective subbeam.

3. The system of claim 2, wherein each beamformer comprises a controller configured to turn off the respective reader and multiplier when the respective beam weight is a zero weight.

4. The system of claim 2, wherein each beamformer comprises a controller configured to turn off the respective reader and multiplier when the respective beamformer does not contribute to the beam.

5. The system of claim 1, wherein each beamformer comprises:

a weight memory configured to store a weight table, the weight table comprising a plurality of beam weights; and a reader configured to read one of the beam weights from the weight table based on a beam index number; and a multiplier configured to multiply the read beam weight with the subchannel data for one of the plurality of subchannels from the respective channelizer to form the respective subbeam.

6. The system of claim 5, wherein each beamformer comprises a controller configured to turn off the respective multiplier when the read beam weight is a zero weight.

7. The system of claim 5, wherein each beamformer comprises a controller configured to turn off the respective multiplier when the respective beamformer does not contribute to the beam.

8. The system of claim 5, wherein each weight table is configured to store zero weights corresponding to beams for which the respective beamformer does not contribute.

9. The system of claim 1, wherein each beamformer comprises:

an input memory configured to store the subchannel data for each of the plurality of subchannels from the respective channelizer into a subchannel table, the subchannel table comprising a plurality of subchannel bins, each subchannel bin corresponding to one of the plurality of subchannels;

a first reader configured to read out the subchannel data for one of the plurality of subchannels from the subchannel table in the input memory based on a subchannel bin number;

a weight memory configured to store a weight table, the weight table comprising a plurality of beam weights; and a second reader configured to read one of the beam weights from the weight table based on a beam index number; and a multiplier configured to multiply the read subchannel data with the read beam weight to form the respective subbeam.

10. The system of claim 9, wherein each beamformer comprises a controller configured to turn off the respective first reader and multiplier when the read beam weight is a zero weight.

11. The system of claim 9, wherein each beamformer comprises a controller configured to turn off the respective first reader and multiplier when the respective beamformer does not contribute to the beam.

12. The system of claim 9, wherein each weight table stores zero weights corresponding to beams for which the respective beamformer does not contribute.

13. The system of claim 9, further comprising:

an index memory configured to store an index table, the index table comprising a plurality of beam index numbers; and for each beamformer, a controller configured to read out one of the beam index numbers from the index table, wherein the respective second reader is configured to read out the beam weight from the respective weight table according to the read beam index number.

14. The system of claim 13, wherein each controller is configured to sequentially read out the beam index numbers from the index table.

15. The system of claim 1, wherein data flow from each antenna element to the combiner only flows through the respective channelizer and the respective beamformer of the channelizers and the beamformers for all the antenna elements.

16. The system of claim 1, wherein the beamformer for each antenna element is configured to sequentially output the subbeams for different ones of the plurality of subchannels to the combiner.

17. A system for beamforming signals for transmission on a plurality of antenna elements, comprising:

a channelizer configured to channelize an input signal into a plurality of subchannels and output subchannel data for each of the plurality of subchannels;

for each antenna element:

a beamformer coupled to the channelizer, the beamformer configured to receive the subchannel data for each of the plurality of subchannels from the channelizer and to multiply the received subchannel data from the channelizer for each of at least one of the plurality of subchannels with a beam weight corresponding to the subchannel and the beamformer to form a subbeam; and a reconstructor coupled to the respective beamformer, the reconstructor configured to process each of the subbeams from the respective beamformer into a reconstructed signal for transmission from the respective antenna element.

18. The system of claim 17, wherein each beamformer comprises:

an input memory configured to store the subchannel data for each of the plurality of subchannels from the channelizer into a subchannel table, the subchannel table comprising a plurality of subchannel bins, each subchannel bin corresponding to one of the plurality of subchannels;

a reader configured to read out the subchannel data for one of the plurality of subchannels from the subchannel table based on a subchannel bin number; and a multiplier configured to multiply the read subchannel data with the respective beam weight to form the respective subbeam.

19. The system of claim 18, wherein each beamformer comprises a controller configured to turn off the respective reader and multiplier when the respective beam weight is a zero weight.

20. The system of claim 18, wherein each beamformer comprises a controller configured to turn off the respective reader and multiplier when the respective beamformer does not contribute to the beam.

21. The system of claim 17, wherein each beamformer comprises:

a weight memory configured to store a weight table, the weight table comprising a plurality of beam weights; and a reader configured to read out one of the beam weights from the weight table based on a beam index number; and a multiplier configured to multiply the read beam weight with the subchannel data for one of the plurality of subchannels from the channelizer to form the respective subbeam.

22. The system of claim 21, wherein each beamformer comprises a controller configured to turn off the respective multiplier when the read beam weight is a zero weight.

23. The system of claim 21, wherein each beamformer comprises a controller configured to turn off the respective multiplier when the respective beamformer does not contribute to the beam.

24. The system of claim 21, wherein each weight table stores zero weights corresponding to beams for which the respective beamformer does not contribute.

25. The system of claim 17, wherein each beamformer comprises:

an input memory configured to store the subchannel data for each of the plurality of subchannels from the channelizer into a subchannel table, the subchannel table comprising a plurality of subchannel bins, each subchannel bin corresponding to one of the plurality of subchannels;

a first reader configured to read out the subchannel channel for one of the plurality of subchannels from the subchannel table in the input memory based on a subchannel bin number;

a weight memory configured to store a weight table, the weight table comprising a plurality of beam weights; and a second reader configured to read out one of the beam weights from the weight table based on a beam index number; and a multiplier configured to multiply the read subchannel data with the read beam weight to form the respective subbeam.

26. The system of claim 25, wherein each beamformer comprises a controller configured to turn off the respective first reader and multiplier when the read beam weight is a zero weight.

27. The system of claim 25, wherein each beamformer comprises a controller configured to turn off the respective first reader and multiplier when the respective beamformer does not contribute to the beam.

28. The system of claim 25, wherein each weight table stores zero weights corresponding to beams for which the respective beamformer does not contribute.

29. The system of claim 25, further comprising:

an index memory that stores an index table, the index table comprising a plurality of beam index numbers; and for each beamformer, a controller configured to read out one of the beam index numbers from the index table, wherein the respective second reader is configured to read out the beam weight from the respective weight table according to the read index beam number.

30. The system of claim 29, wherein each controller is configured to sequentially read out the beam index numbers from the index table.

* * * * *